US007356970B1

(12) United States Patent
Frobosilo

(10) Patent No.: US 7,356,970 B1
(45) Date of Patent: Apr. 15, 2008

(54) METAL BUILDING CONSTRUCTION

(76) Inventor: Raymond C. Frobosilo, 253 Blackheath Rd., Lido Beach, NY (US) 11561

( * ) Notice: Subject to any disclaimer, the term of this patent is extended or adjusted under 35 U.S.C. 154(b) by 318 days.

(21) Appl. No.: 10/801,068

(22) Filed: Mar. 15, 2004

(51) Int. Cl.
*E04B 1/08* (2006.01)

(52) U.S. Cl. ..... 52/261; 52/275; 52/272; 52/270; 52/276; 52/579; 52/462

(58) Field of Classification Search ..... 52/275, 52/588.1, 462, 280, 264, 519, 536, 293.3, 52/276, 278, 279, 272, 277, 270, 579, 261
See application file for complete search history.

(56) References Cited

U.S. PATENT DOCUMENTS 2,053,482 A * 9/1936 Kellogg ..... 52/275
2,186,310 A * 1/1940 Von Hoefen ..... 52/236.7
2,590,123 A * 3/1952 Rapp ..... 52/262
2,612,246 A * 9/1952 Whitehouse et al. ..... 52/275
3,196,993 A * 7/1965 Holloman ..... 52/276
3,300,934 A * 1/1967 Waizenhofer ..... 52/394
3,568,388 A * 3/1971 Flachbarth et al. ..... 52/588.1
3,820,295 A * 6/1974 Folley ..... 52/270
3,956,998 A * 5/1976 Bavetz ..... 110/336
3,959,942 A * 6/1976 Merson ..... 52/551
3,969,866 A 7/1976 Kyne
4,078,347 A * 3/1978 Eastman et al. ..... 52/302.3
4,099,356 A * 7/1978 Graham ..... 52/520
4,109,438 A * 8/1978 De la Concha ..... 52/630
4,168,596 A 9/1979 Yoder, Jr.
4,182,080 A * 1/1980 Naylor ..... 49/410
4,267,679 A 5/1981 Thompson
4,316,351 A * 2/1982 Ting ..... 52/309.9
4,372,901 A * 2/1983 Kim ..... 264/46.5
4,450,970 A 5/1984 Shepherd
4,532,746 A * 8/1985 Gartner ..... 52/276
4,546,590 A * 10/1985 Finch et al. ..... 52/520
4,561,233 A * 12/1985 Harter et al. ..... 52/506.1
4,594,822 A 6/1986 Marschak
4,633,634 A * 1/1987 Nemmer et al. ..... 52/474
5,117,602 A * 6/1992 Marschak ..... 52/376
5,526,628 A * 6/1996 Knudson ..... 52/528
5,561,955 A 10/1996 Frobosilo et al.
5,687,538 A * 11/1997 Frobosilo et al. ..... 52/731.7
5,720,571 A 2/1998 Frobosilo et al.
5,740,648 A * 4/1998 Piccone ..... 52/426
5,836,131 A 11/1998 Viola et al.

(Continued)

FOREIGN PATENT DOCUMENTS

EP 445866 * 9/1991 ..... 52/272

(Continued)

OTHER PUBLICATIONS

StructAll Metal Building System, A Technological Break Thru In Building Construction, The Profit Opportunity of a Lifetime HJM Industrial Design, Howard J. Marschak (Jul. 14, 1988).

*Primary Examiner*—Richard Chilcot
*Assistant Examiner*—Phi Dieu Tran A
(74) *Attorney, Agent, or Firm*—Notaro & Michalos P.C.

(57) ABSTRACT

A metal building is disclosed that employs interlocking vertically extended panels of improved configuration including improved insulated wall panels, unique corner constructions, and unique window and door arrangements.

20 Claims, 19 Drawing Sheets

U.S. PATENT DOCUMENTS

| | | | | |
|---|---|---|---|---|
| 5,846,018 | A | 12/1998 | Frobosilo et al. | |
| 5,979,136 | A * | 11/1999 | Marschak | 52/588.1 |
| 6,047,510 | A * | 4/2000 | Gallaway | 52/347 |
| 6,213,679 | B1 | 4/2001 | Frobosilo et al. | |
| 6,568,144 | B2 * | 5/2003 | Meredith | 52/656.1 |

FOREIGN PATENT DOCUMENTS

| | | | | |
|---|---|---|---|---|
| EP | 504900 | * | 3/1992 | 52/272 |
| GB | 2029482 | * | 3/1980 | 52/275 |
| GB | 2168400 | * | 6/1986 | 52/588.1 |

* cited by examiner

METAL BUILDING CONSTRUCTION

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to metal building constructions. More particularly, the present invention relates to an improved metal building construction that utilizes metal wall panels having edge portions that interlock in a unique manner including at corners, doors and windows using specially configured Z-shaped portions. Each of the panels provide flange portions that extend toward each other enabling connection thereto of standard inside surface building materials such as Sheetrock®, paneling, etc.

2. General Background of the Invention

Buildings have been constructed of metal framework in many fashions. The following table lists patents that show examples of buildings that use a metal framework. A review of these patents will show that some of them use vertically oriented interlocking panels having Z-shaped interlocking portions.

TABLE 1

| U.S. Pat. No. | Title | Issue Date |
|---|---|---|
| 4,594,822 | Structural Panel for Building Structure | Jun. 17, 1986 |
| 5,117,602 | Structural Panel for Pre-fabricated Buildings | Jun. 02, 1992 |
| 5,979,136 | Prefabricated Structure Panel | Nov. 09, 1999 |

BRIEF SUMMARY OF THE INVENTION

The present invention provides a metal building that includes an underlying support such as a slab supporting a plurality of walls that are formed of generally vertically oriented interlocking metal panels, each wall having an outer surface and an inner surface.

The metal panels include wall panels having opposed wall panel edge portions. The metal panels also include a plurality of metal corner panels having opposing corner edge portions that each connect with a pair of wall panels at wall panel edge portions. The wall panel edge portion of one panel connect with edge portions of two other metal panels such as for, for example, a corner panel and a wall panel, or two wall panels, or a panel that is part of a door or part of a window truss.

Each of the panels have side panel sections with respective opposed flange portions that extend toward each other. Connections join the panels together at interlocking sections that are in part Z-shaped and that extend transversely with respect to the wall outer surface.

The wall inner surface is preferably defined by a veneer (for example, sheet rock, wood paneling, synthetic paneling or the like) that is connected to the metal panels at the flange portions. A cover (for example, roof) attaches to the walls to shield all or part of the interior of the building from the elements.

The metal building preferably includes at least one wall with a door. The metal building can include at least one wall with a window. The wall panels each have a width. The door has a width. The door width is less than the width of a plurality of short wall panels that are part of a truss positioned above the door. The wall panels have a width and each window has a width. The window width is less than the width of a plurality of the wall panels that are part of a truss positioned above and/or below the window.

A truss can be provided that is formed in part of a plurality of short wall panel sections that are attached above and below to truss beams, the truss having edge portions that connect to full length wall panel edge portions.

Vertical columns can be provided that support the truss at positions on opposing sides of a window, wherein the distance between the columns is greater than the width of the window. Each of the columns preferably supports an end portion of the truss that is supported above the window. A somewhat similar arrangement utilizes a truss above each door. Each column can include a pair of sections that are movable relative to one another.

Corner constructions are provided that enable standard width interlocking wall panels to be utilized. In one embodiment, the corner construction uses a corner panel having two panels or legs that form an angle of about ninety degrees and that can be of the same length or different lengths.

In another embodiment, a corner column of special configuration connects with a pair of corner panels that can be of the same length or different length.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
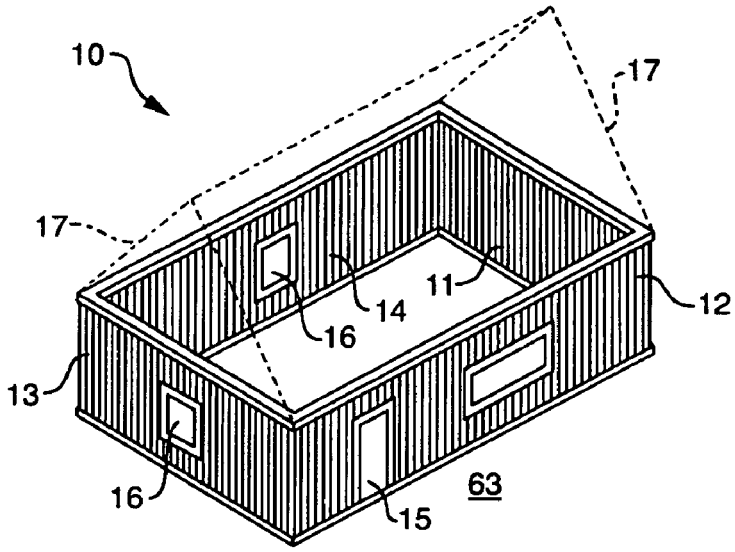
FIG. 1 is a perspective view of the preferred embodiment of the apparatus of the present invention.

The present invention provides a metal building 10 that can be constructed of a plurality of connected walls 11, 12, 13, 14 and a cover or roof 17. Each wall 11, 12, 13, 14 can be a solid wall or can be fenestrated, providing one or more windows 16 and/or one or more doors 15. Building 10 can be constructed upon slab 63.

Each wall 11, 12, 13, 14 is constructed of a plurality of interlocking panels. A wall that is not fenestrated is constructed using a plurality of full length panels 18 that can each be of a selected standard height, e.g. eight, ten, twelve or more feet tall. In FIGS. 2-5, each panel 18 is preferably vertically extended and connected to an adjacent panel (or panels) 18 or to a corner panel 37, 102, 103 (see FIGS. 7, 23-25, 27-28).

Figure 5:
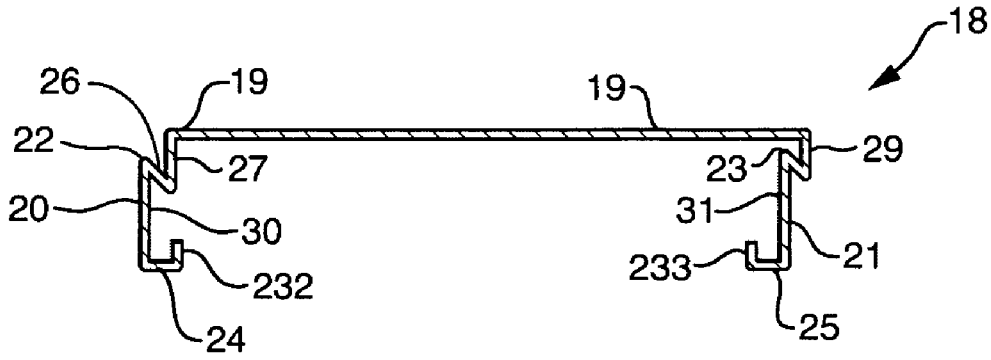
FIG. 5 is a sectional view taken alone lines 5-5 of FIG. 3.
Figure 6:
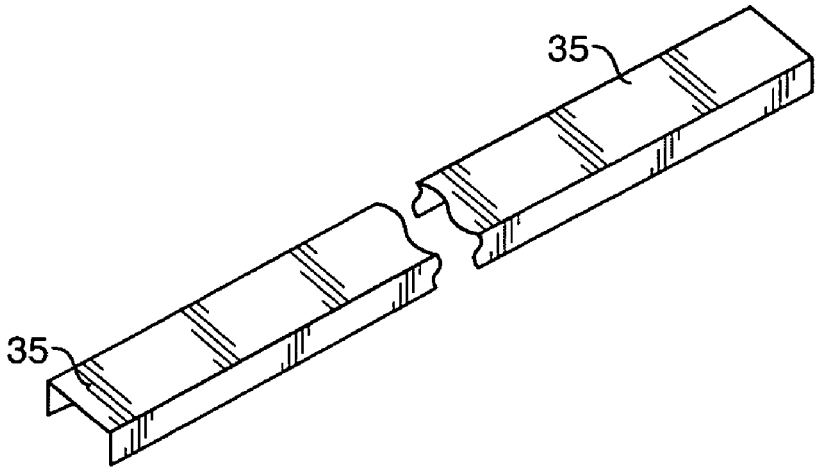
FIG. 6 is a partial perspective view of the preferred embodiment of the apparatus of the present invention.

In FIG. 5, the panel 18 can be seen in a plan sectional view to show its transverse cross section. Panel 18 has an enlarge planar front panel 19 connected to a pair of opposed side panels 20, 21. Each panel 20, 21 is an interlocking panel that enables one panel 18 to interlock with another panel or 18 or with a correspondingly shaped portion of a corner panel or a truss.

The interlocking portions include Z-shaped sections 22, 23 that define an interface between the side panels 20, 21 and enlarged planar front panel 19. Enlarged planar front panel 19 can be flat, defining a plane that is also the plane of the wall 11, 12, 13 or 14 that it is a part of side panels 20, 21 preferably form an angle of about ninety degrees with enlarged planar from panel 19.

Each wall panel 18 has a pair of opposed rear panels 24, 25. Rear panels 24, 25 extend inwardly toward each other as shown in FIG. 5. Z-shaped portions 22, 23 include diagonally extending sections 26, 28 respectively. The Z-shaped portions 22, 23 include side panel sections that form an acute angle with a diagonally extended section 26 or 28. In FIG. 5, diagonal section 26 forms an acute angle with side panel section 27. Side panel section 27 can form an angle of about ninety degrees with front panel section 19. Diagonal section 26 forms a acute angle with side panel section 30. Side panel section 30 forms an angle of about ninety degrees with rear panel section 24.

Similarly, Z-shaped portion 23 includes diagonal section 28 that forms an acute angle with each of the side panel sections 29, 31. Side panel section 29 forms an angle of about ninety degrees with front panel section 19. Side panel section 31 forms an angle of about ninety degrees with rear panel section 25. Each rear panel section 24, 25 can be strengthened by a transverse panel 232, 233 that extends from each rear panel 24, toward front panel 19 as seen in FIG. 5.

Figure 3:
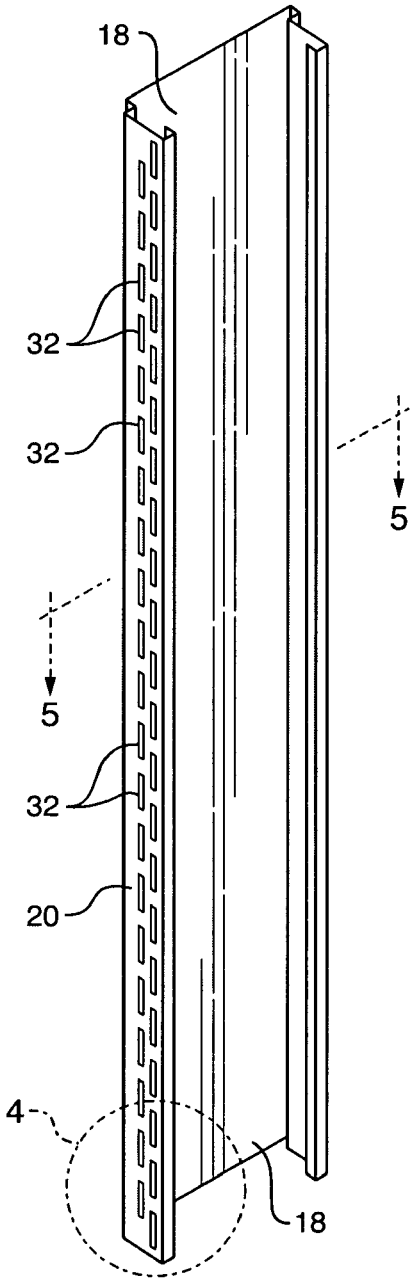
FIG. 3 is a partial perspective view of the preferred embodiment of the apparatus of the present invention.
Figure 4:
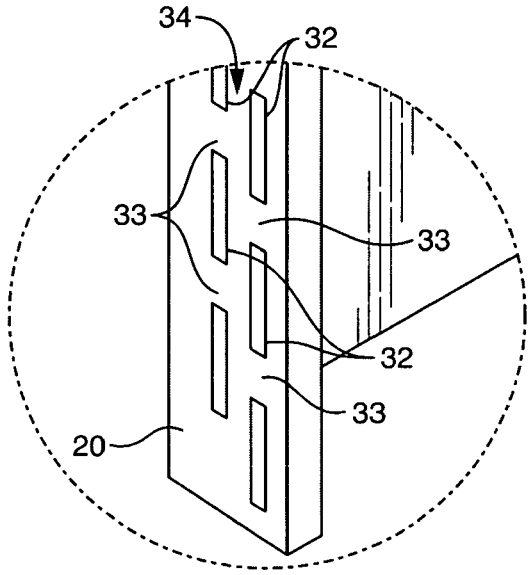
FIG. 4 is a partial perspective view of the preferred embodiment of the apparatus of the present invention.

Each panel 18 can be slotted to retard heat transfer between front panel 18 and rear panels 24, 25. In FIGS. 3 and 4, two rows of slits or slots 32 are shown extending vertically along side panel section 20. Similarly positioned slits 32 can be provided on side panel section 21. The slits 32 have gaps 33 therebetween. Each row of slits 32 is separated from the other side by space 34 (see FIG. 4). The slits 32 are staggered as shown so that a gap 33 of one row of slits 32 aligns with the center part of a slit 32 in a different row as seen in FIG. 4. Any other pattern of slits or holes or openings can be provided in the side panel sections 20, 21 that retards heat transfer between the front panel section 19 and rear panel sections 24, 25.

In FIGS. 1, 2, 6, 7, 8, 9, 16, a wall 11-14 can be constructed of wall panels 18, corner panels 37, 102, 103 and longitudinal beams 35, 36. The beams 35, 36 can be channel beams as shown. A lower longitudinal beam 36 supports and is connected to wall panels 18. An upper longitudinal beam 35 connects to the upper end of a plurality of wall panels 18.

Fasteners such as sheet metal screws 38 can be used to fasten panels 18 to beams 35, 36. Fasteners such as sheet metal screws 38 can be used to fasten wall panels 18 together (see FIG. 2). Fasteners such as sheet metal screws 38 can be used to attach beam 35, 36 and panels 18 to corner panel section 37 (see FIG. 7). At a corner of the building 10, one beam 35 can be cut to provide cut-out or opening 39 that receives another beam 35.

Figure 7:
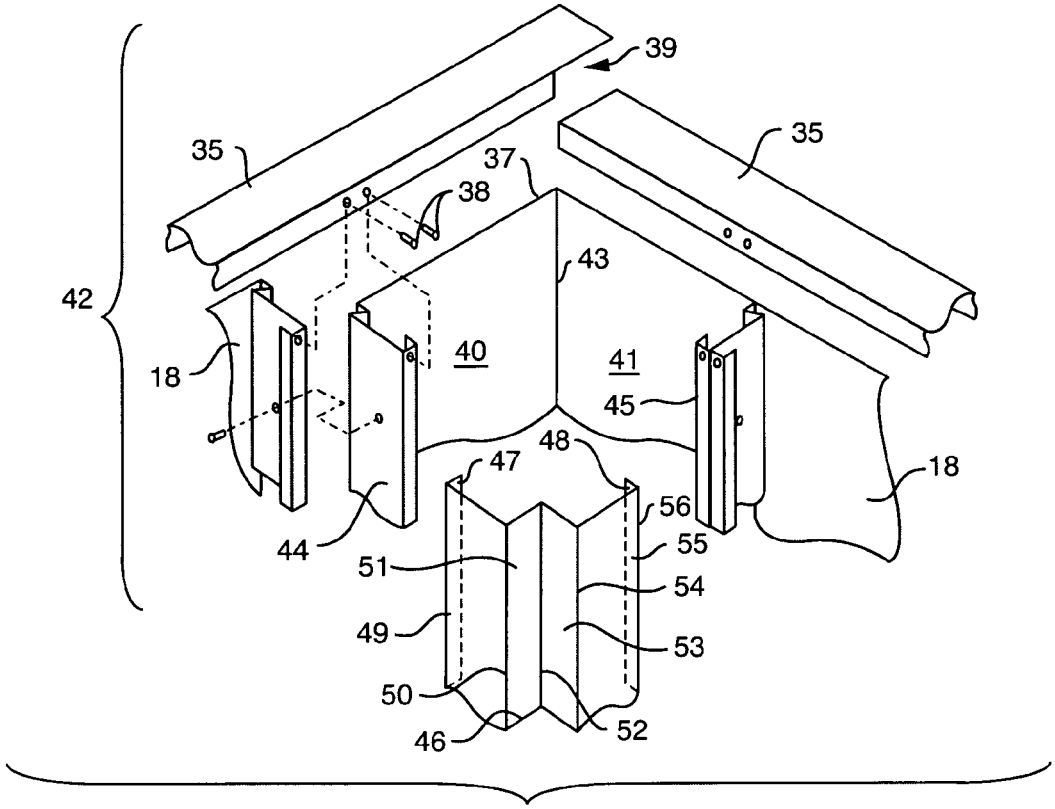
FIG. 7 is an exploded partial perspective view of the preferred embodiment of the apparatus of the present invention illustrating an optional corner construction.
Figure 8:
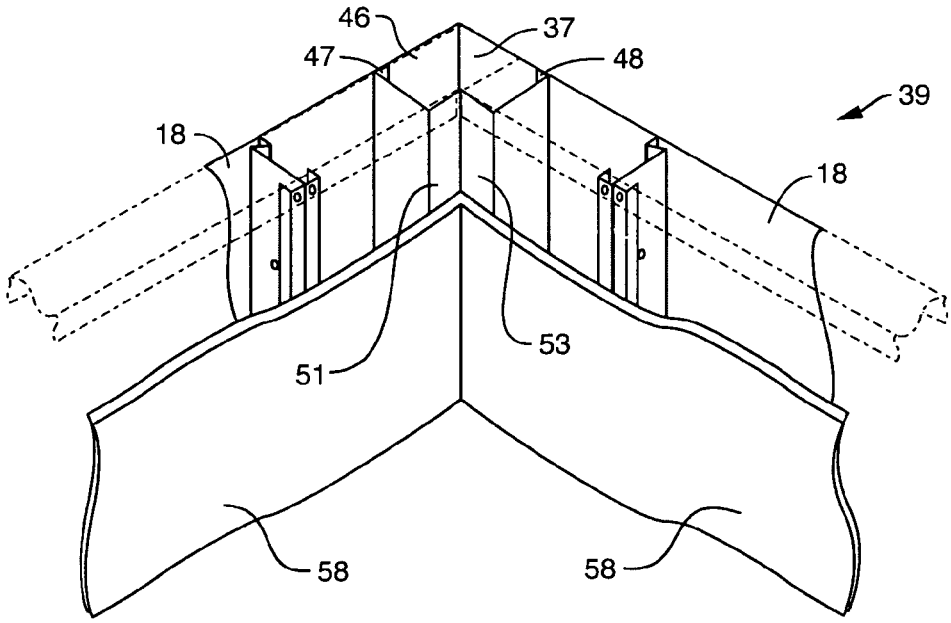
FIG. 8 is a partial perspective view of the preferred embodiment of the apparatus of the present invention illustrating an optional corner construction.

A corner is constructed as shown in FIGS. 7 and 8. Each corner is designated generally by the numeral 42 and is constructed using corner panel 37 and its reinforcement 46. Panel 37 includes two panel sections 40, 41 that are joined together at bend 43 forming an angle of about ninety degrees. Each corner panel 37 has interlocking panels 44, 45. Panel section 40 has interlocking panel 44. Panel 41 has interlocking panel 45.

Figure 2:
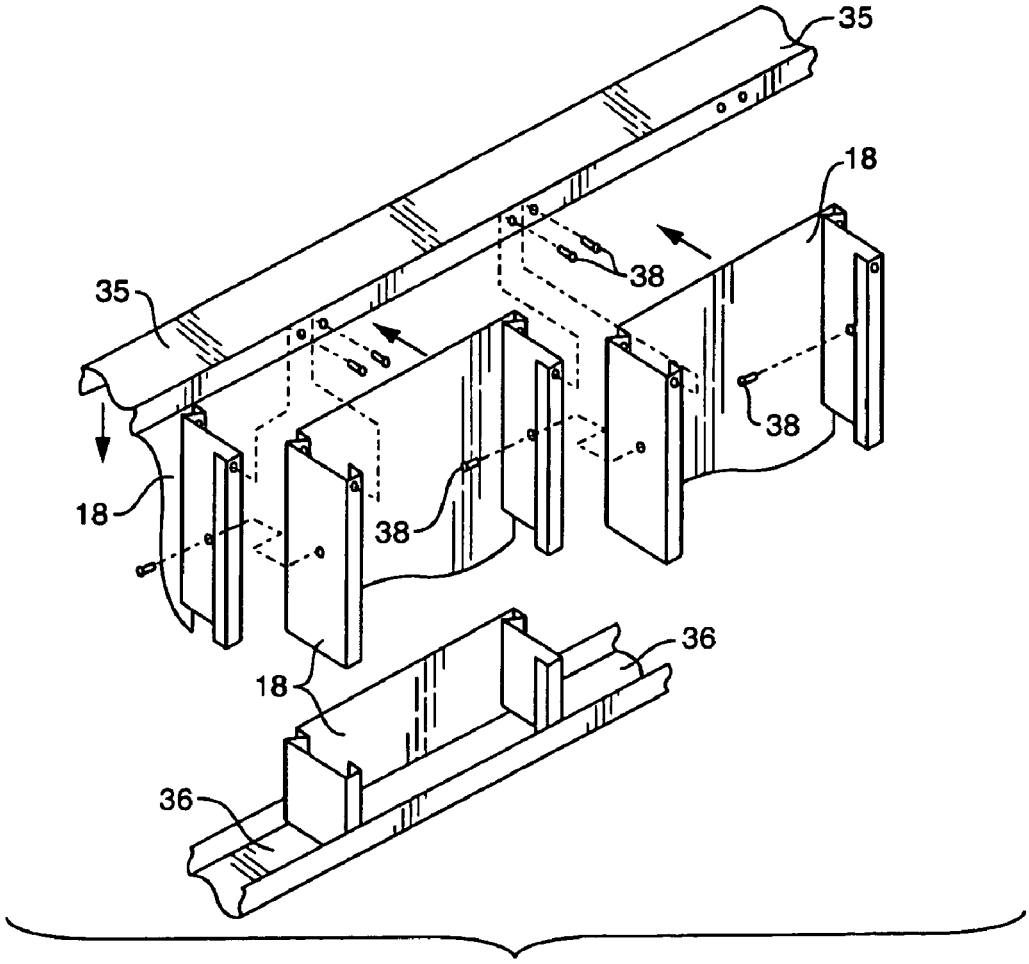
FIG. 2 is a fragmentary exploded perspective view of the preferred embodiment of the apparatus of the present invention.
Figure 16:
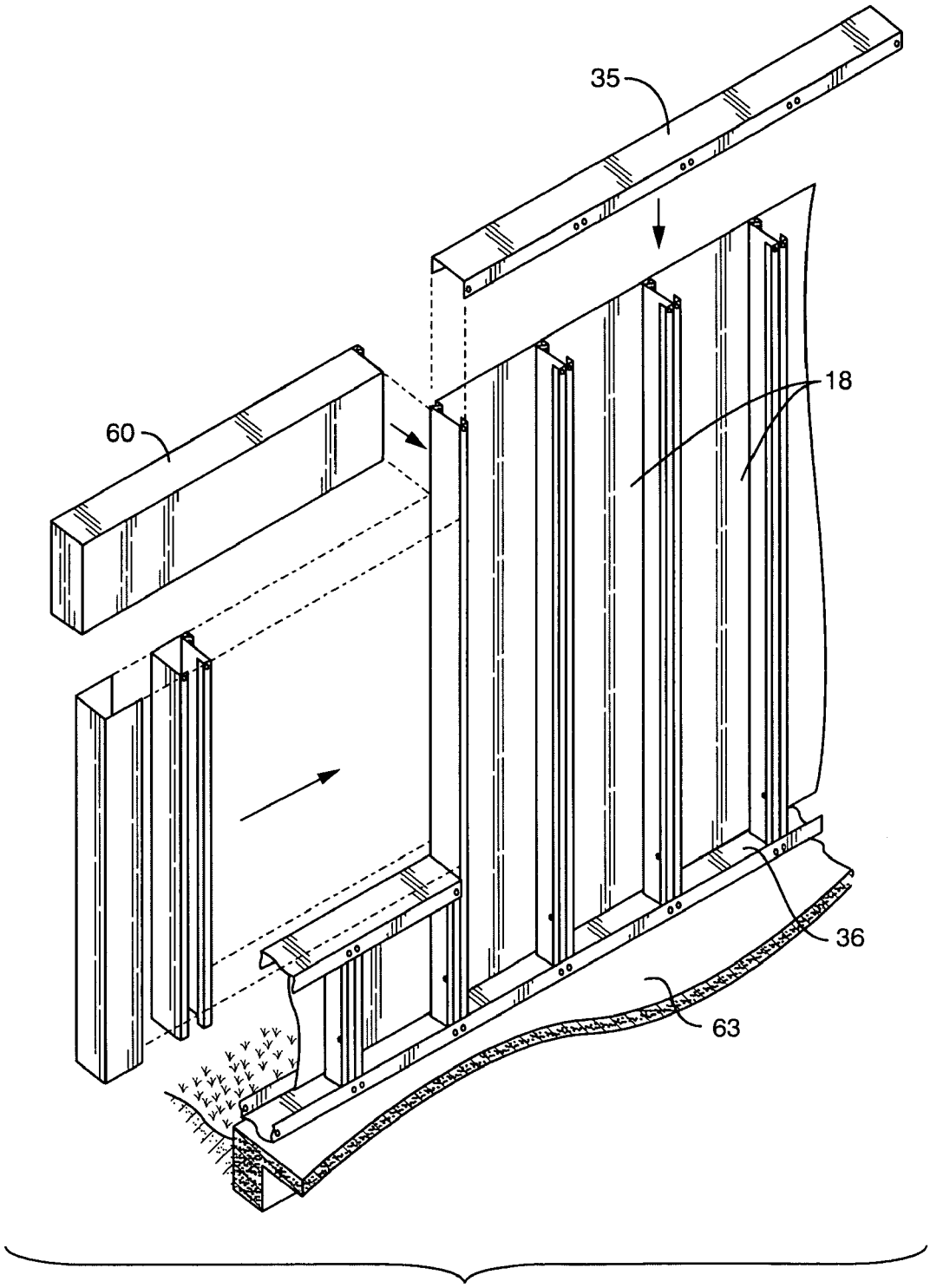
FIG. 16 is a partial perspective view of the preferred embodiment of the apparatus of the present invention.

Interlocking panels 44,45 are constructed in the same fashion as the side panels 20, 21 of FIG. 5. In fact, the corner panel 37 can be constructed by bending a wall panel 18. In this fashion, as the wall panels 18 will interlock, one panel with the next as shown in FIGS. 2 and 16, a corner panel 37 will interlock with two side panels 18. Corner reinforcement 46 has flanges 47,48 that attach respectively to panels 40, 41 as shown in FIG. 8. The corner reinforcement 46 provides a number of different panel sections that are connected at bends 50 or 52 as shown in FIG. 7. Panel section 49 connected to panel section 51 at bend 50 and panel section 51 connects with panel section 53 at bend 52. Panel sections 51, 53 form an angle of about ninety degrees. A recess received Sheetrock®, synthetic wood, wood, or any other inside wall panel material known in the art.

Corner reinforcement 46 includes panel section 55 that connects to panel section 53 at bend 54. Bend 56 forms a connection between flange 48 and panel section 55. Fasteners such as sheet metal screws 38 can be used to attach reinforcement 46 to corner panel 37. Fasteners such as sheet metal screws 38 can be used to attach wall panels 18 to corner panel 37 and wherein interlocking portions 44, 45 form interlocking connections as shown in FIG. 8 with the side panels 21, 20 respectively of wall panels 18.

Figure 9:
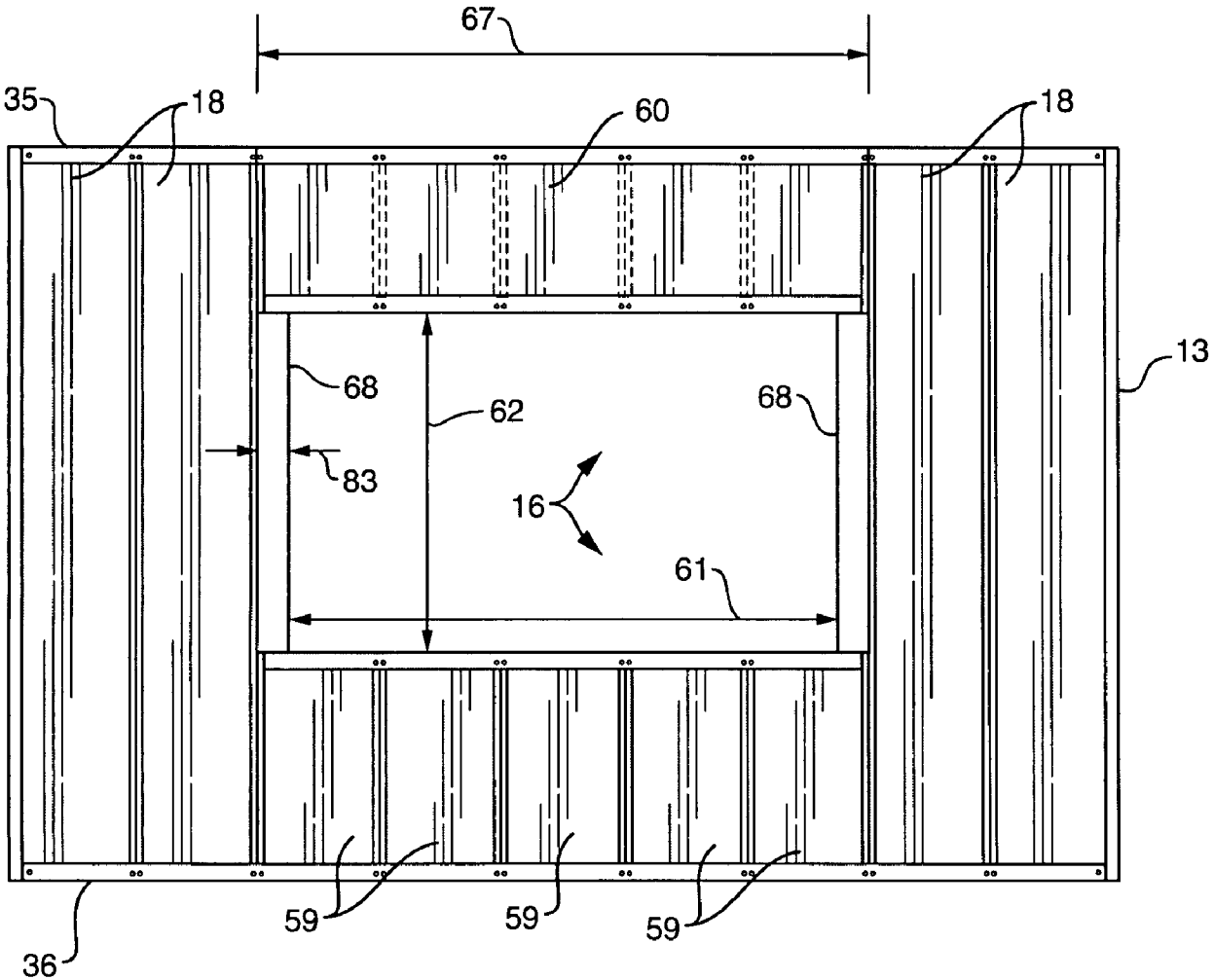
FIG. 9 is a partial elevation view of the preferred embodiment of the apparatus of the present invention.
Figure 10:
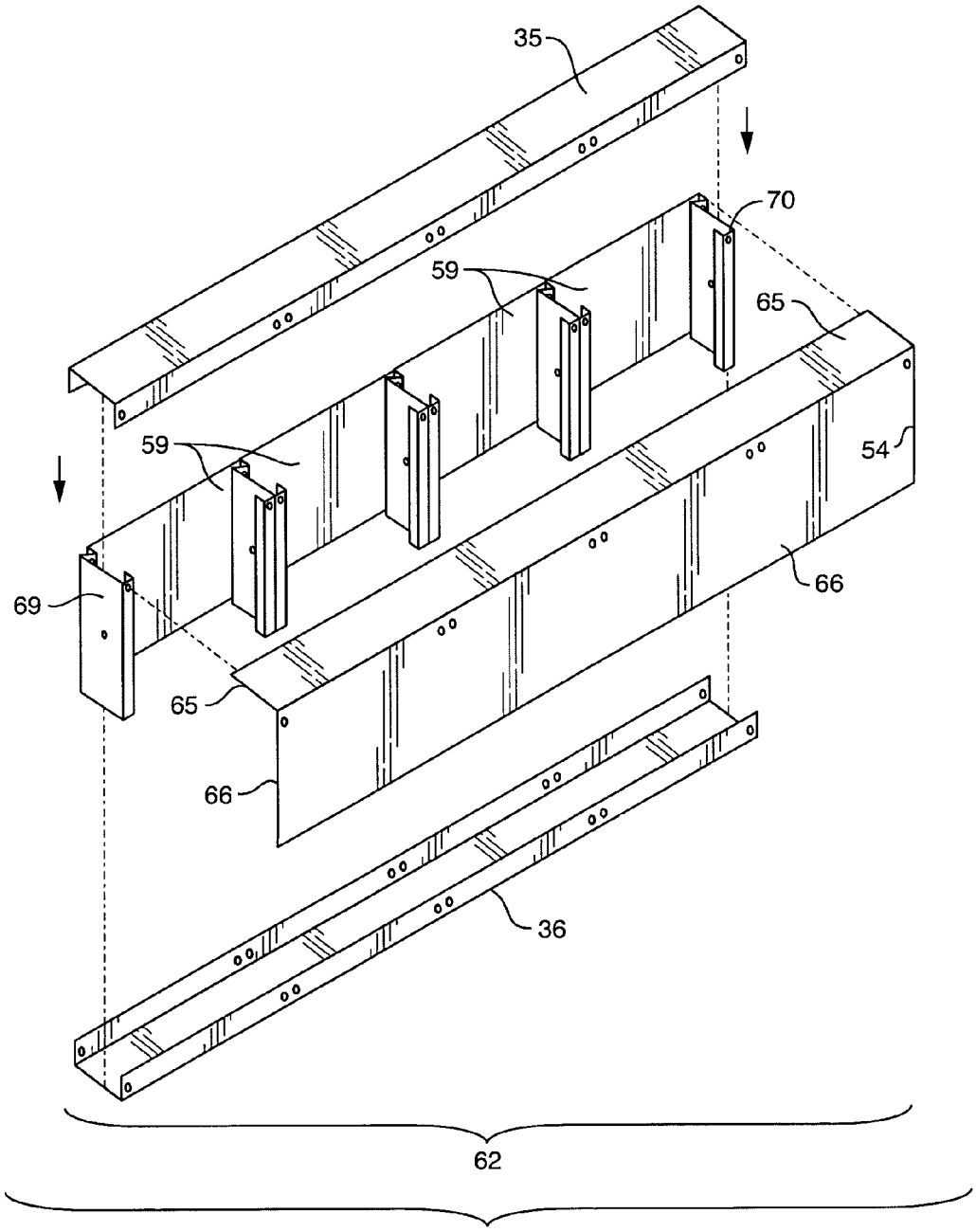
FIG. 10 is a partial perspective exploded view of the preferred embodiment of the apparatus of the present invention.
Figure 11:
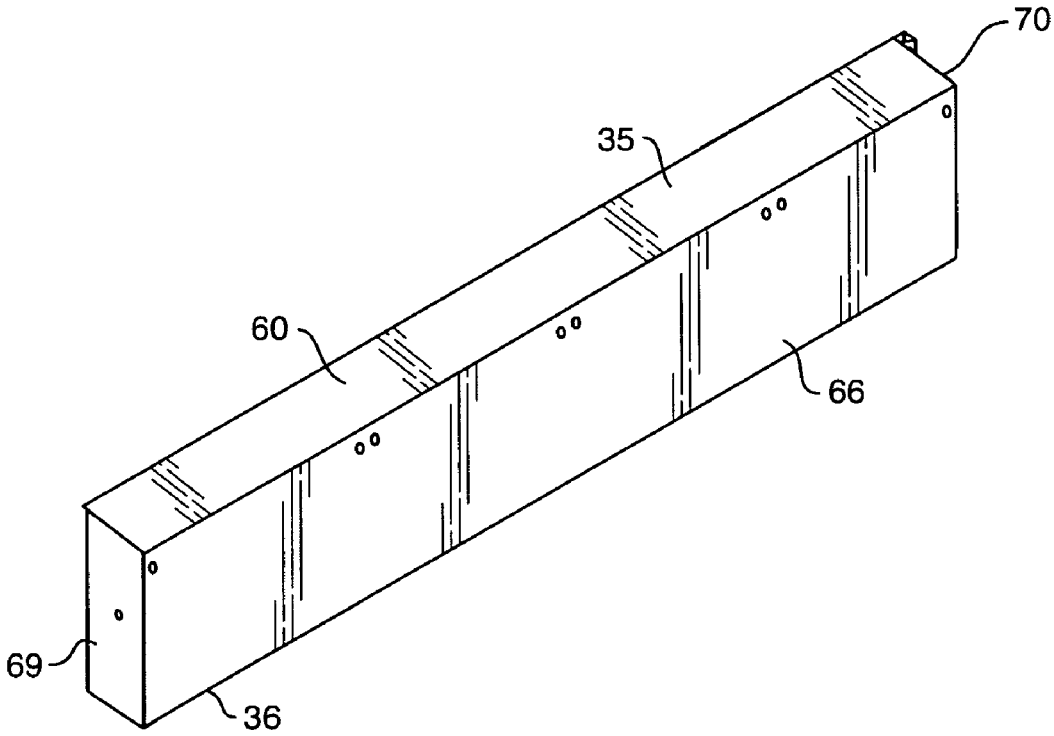
FIG. 11 is a partial perspective view of the preferred embodiment of the apparatus of the present invention.
Figure 12:
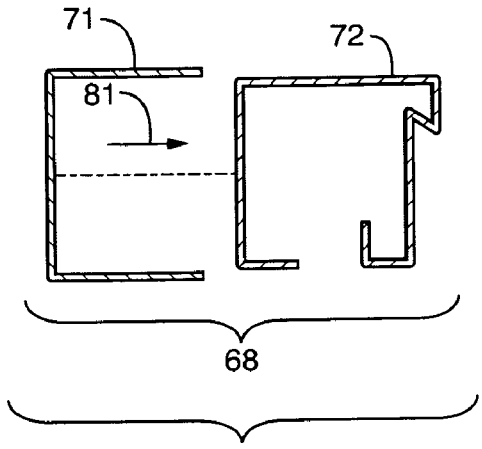
FIG. 12 is a partial plan view of the preferred embodiment of the apparatus of the present invention illustrating one of the columns that can be used to support a window or door truss.
Figure 13:
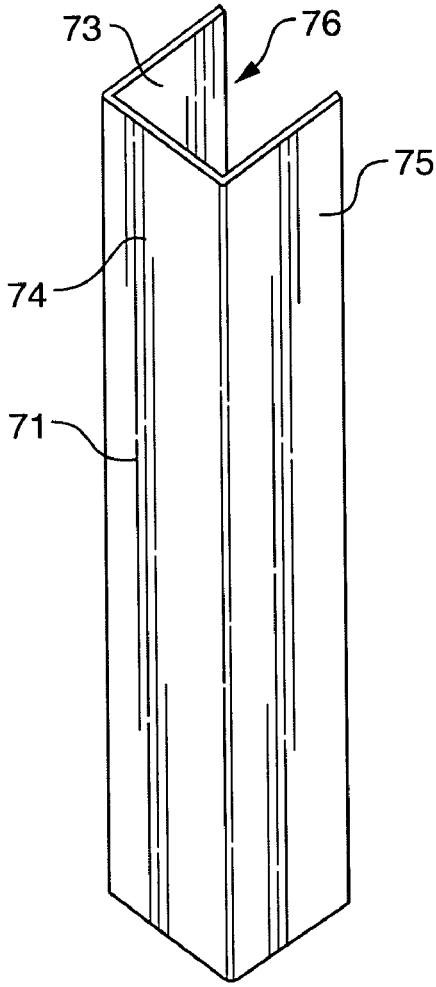
FIG. 13 is a partial perspective view of the column shown in FIG. 12.
Figure 14:
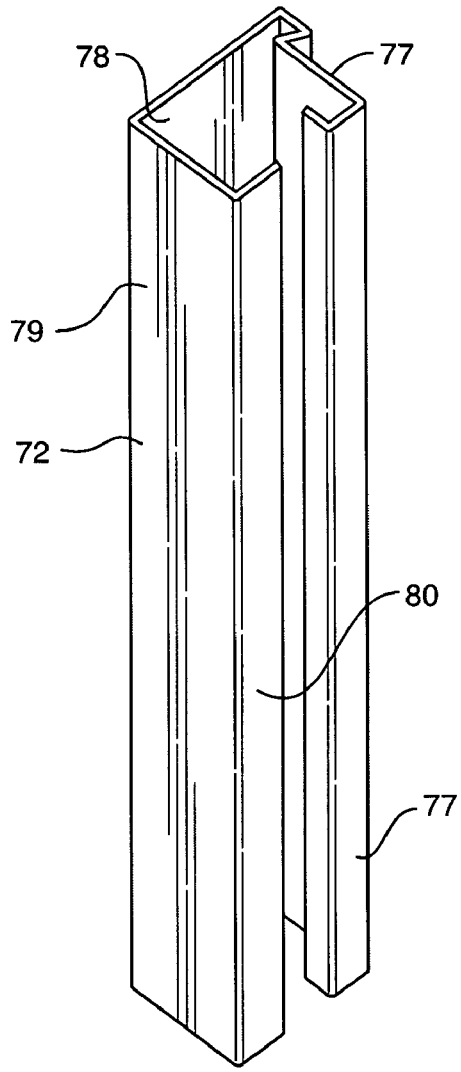
FIG. 14 is a partial perspective view of the column shown in FIG. 12.

FIGS. 9-16 show a construction of a wall 12, 13, 14 that provides a window 16. In FIG. 9, wall 13 is comprised of an upper longitudinal beam 35, lower longitudinal beam 36, a plurality of full length metal wall panels 18, a truss 60, and a plurality of short wall panels 59. The window 16 provides a window opening width 61 and a window opening height 62. In FIG. 9, the window width 61 is less than the distance defined by a plurality of panel sections 18 or 59. For example, in FIG. 9, there are five short wall panels 59 above and five short wall panels below window opening 16. The combined width 67 of these five panels 59 is more than the width 61 of the window opening 16. This construction enables a column 68 to be placed under each end portion of truss 60 and at the same time interlock with a full length wall panel 18. In FIGS. 10 and 11, each wall panel 59 includes an interlocking end portion that is of the same configuration as the interlocking portions of the side panels 20, 21 of a full length wall panel 18 as shown in FIG. 5. These interlocking portions 69, 70 at the end of each truss 60 for interlocking a column 68 that supports an end portion of truss 60.

The truss also includes inside plate reinforcement member 64 that includes panels 65 and 66 that form an angle of about ninety degrees. To complete the truss 60, upper and lower longitudinal beams 35, 36 respectively are attached to the top and bottom of the connected short wall panel sections.

FIGS. 12-16 show more particularly the construction of a column 68 and its interlocking connection with an end portion of truss 60. Each column 68 is of preferably two parts. These include column part 71 and column part 72. The column part 71 can include three intersecting flanges 73, 74, 75 and a recess 76 that receives column part 72. The column part 72 includes an interlocking portion 77 that forms an interlocking connection with an interlocking portion 69, 70 of truss 60.

Figure 15:
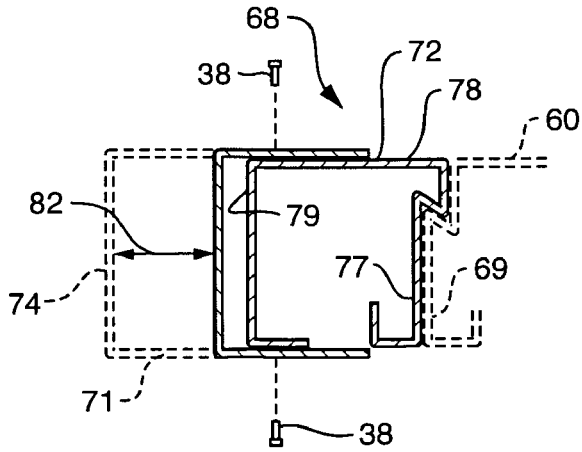
FIG. 15 is a fragmentary plan, sectional view of the preferred embodiment of the apparatus of the present invention.

The interlocking connection between part 77 of column part 72 and an interlocking portion 69 or 70 of truss 60 can be seen in FIG. 15 and is the same interlocking connection that employs Z-shaped portions used to connect wall panels 18 together and used to connect a wall panel 18 to a corner panel 37.

In addition to the interlocking portion 77, column part 71 includes flanges 78, 79, 80. As indicated by arrows 81, 82 in FIGS. 12 and 15 the column parts 71, 72 are adjustable with respect to each other so that the distance between flange 74 and flange 79 can be selected and then affixed using a fastener 38 such as a sheet metal screw.

In this fashion, any window of desired width 61 can be made by selecting a column 68 that has a combined installed width 83 (FIG. 9) equal to one-half the distance that remains when subtracting the overall width of the truss 67 (always a multiplier of a panel 18 or 59 width) minus the width 61 of the window. Because each column 68 interlocks with a full length panel 18 and because each truss 60 20 interlocks with a full length panel 18, a very strong rigidified construction can be obtained for any wall 13 that includes a window opening 16.

Figure 17:
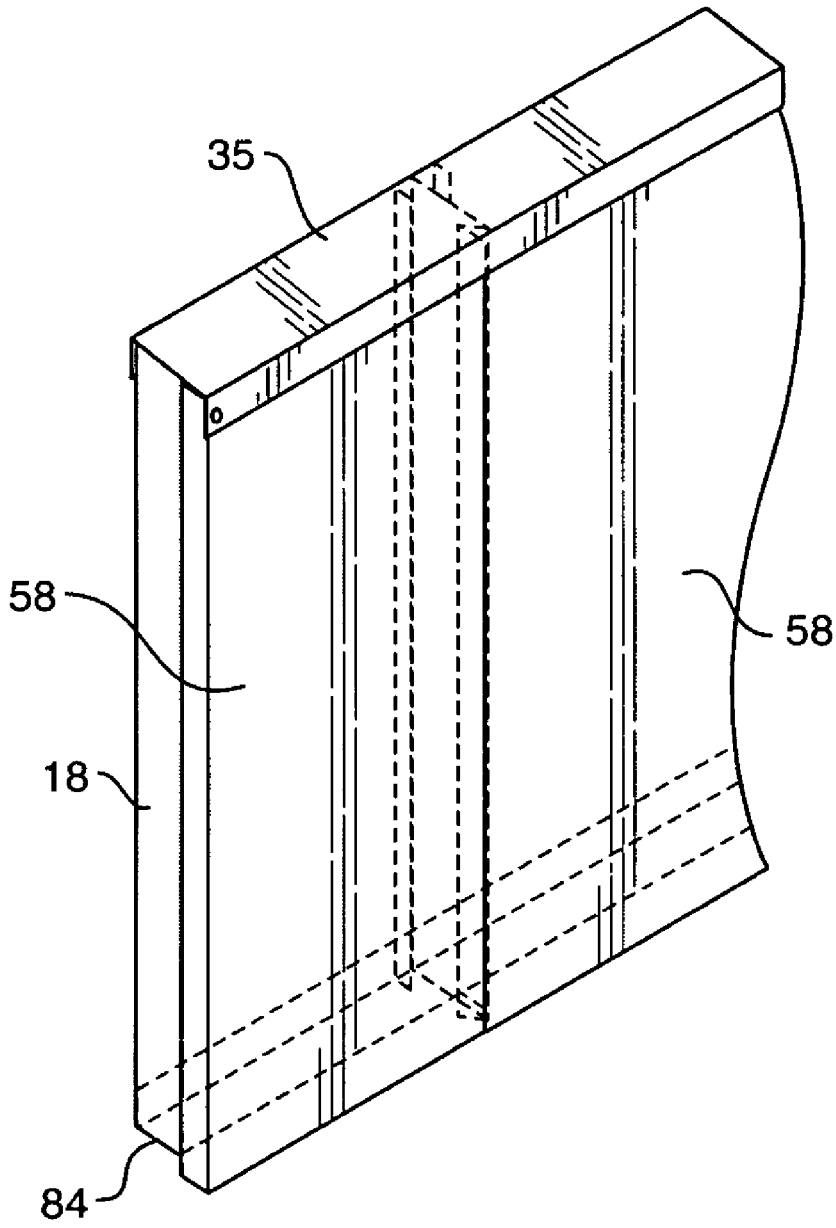
FIG. 17 is a partial perspective view of the preferred embodiment of the apparatus of the present invention illustrating a portion of the wall.
Figure 18:
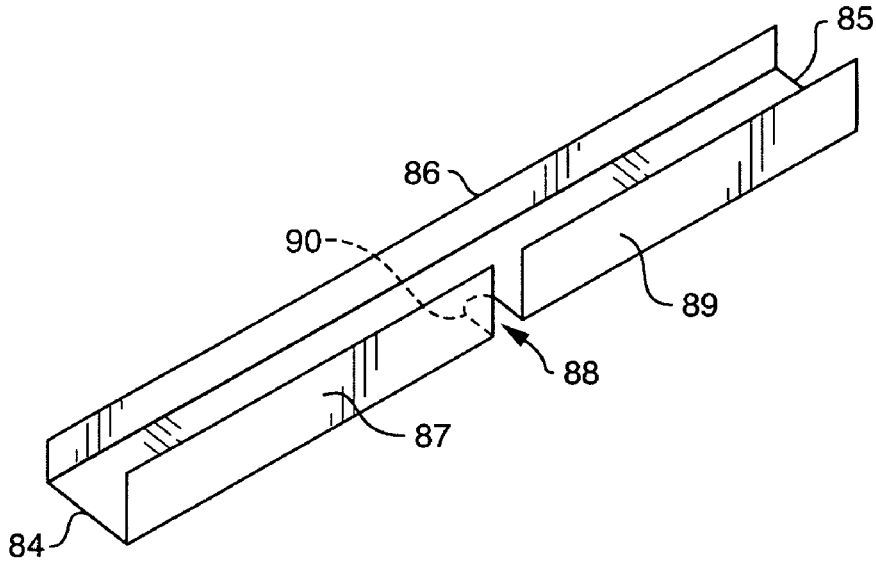
FIG. 18 is a partial perspective view of the preferred embodiment of the apparatus of the present invention illustrating one of the lower longitudinal beams having an improved slotted construction.

In FIG. 17, 18, 19 a lower longitudinal beam 84 is shown that is comprised of a web 85 and a pair of flanges 86, 87 each preferably forming an angle of about ninety degrees with the web 85. Both web 85 and flange 87 are slotted. Preferably, the slot is L-shaped, so that at about the same position along the beam 84, the flange 87 is completely slotted and the web 85 is partially slotted. This construction can be seen in FIG. 18 wherein the slot 88 is comprised of a slotted portion 89 on flange 87 and a slotted portion 90 on web 85.

Figure 19:
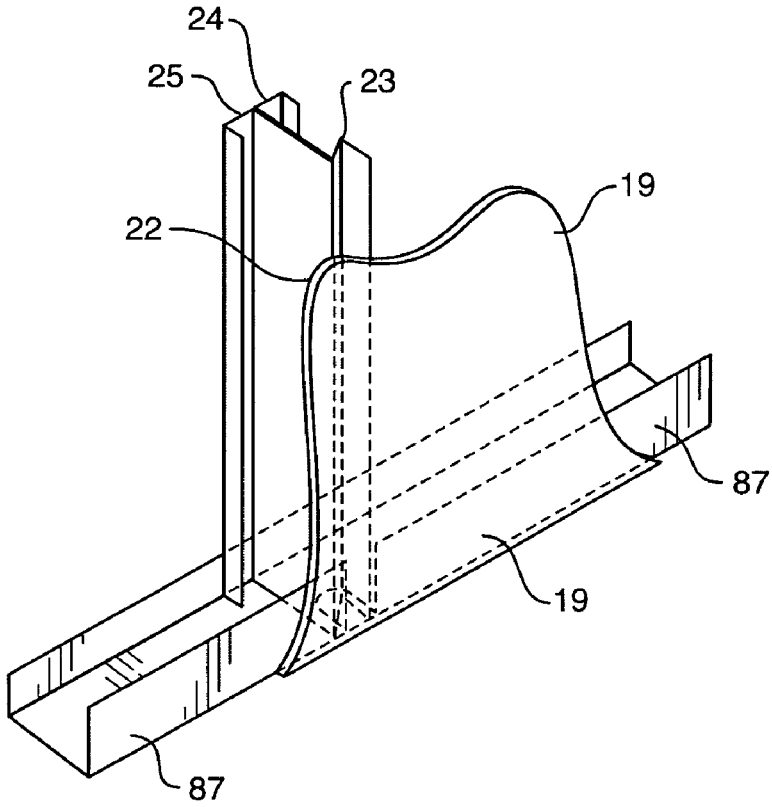
FIG. 19 is a partial perspective view of the preferred embodiment of the apparatus of the present invention illustrating a portion of a wall that utilizes the slotted longitudinal beam of FIG. 18.

Lower longitudinal beam 84 slotted portion 90 enables the front panel section 19 of a full length wall panel 18 to be placed outside of flange 87, contacting the outer surface of flange 87. Such a construction is useful when the building 10 to be construction is subjected to a rainy environment. The interlocking side portions 20, 21 of wall panels 18 pass through the slotted portion 89 and flange 87 as shown in FIGS. 17 and 19. The slotted portion 90 provides a drain so that any water that does accumulate on web 85 of beam 84 will drain through slotted portion 90.

Figure 20:
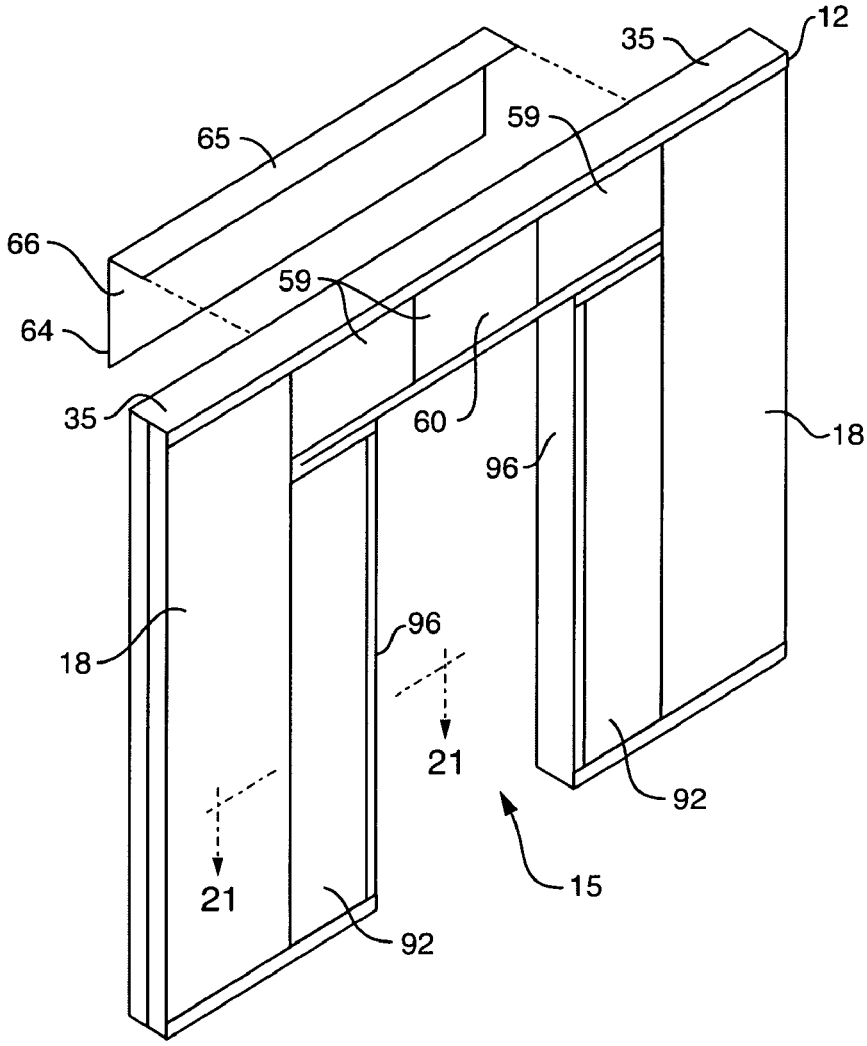
FIG. 20 is a partial perspective exploded view of the preferred embodiment of the apparatus of the present invention illustrating the door construction.
Figure 21:
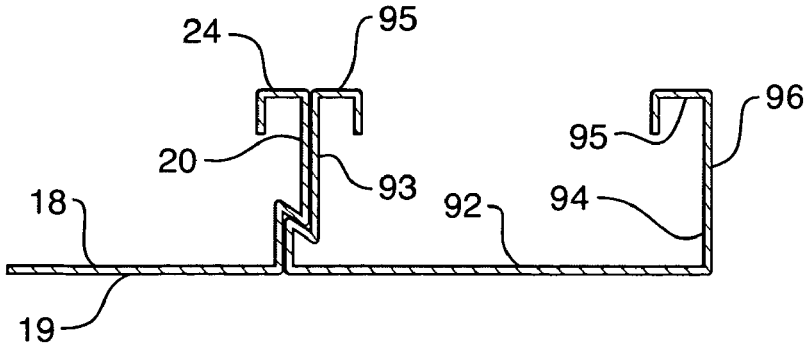
FIG. 21 is a sectional view taken along lines 21-21 of FIG. 20.
Figure 22:
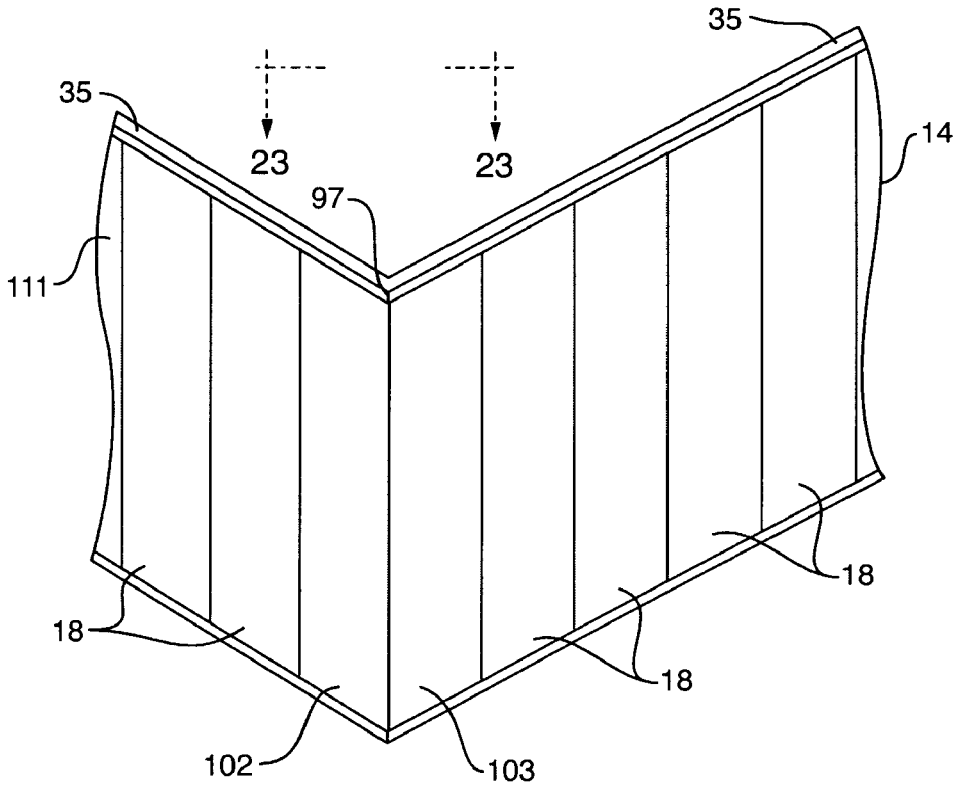
FIG. 22 is a partial perspective view of the preferred embodiment of the apparatus of the present invention, illustrating an optional corner construction.
Figure 23:
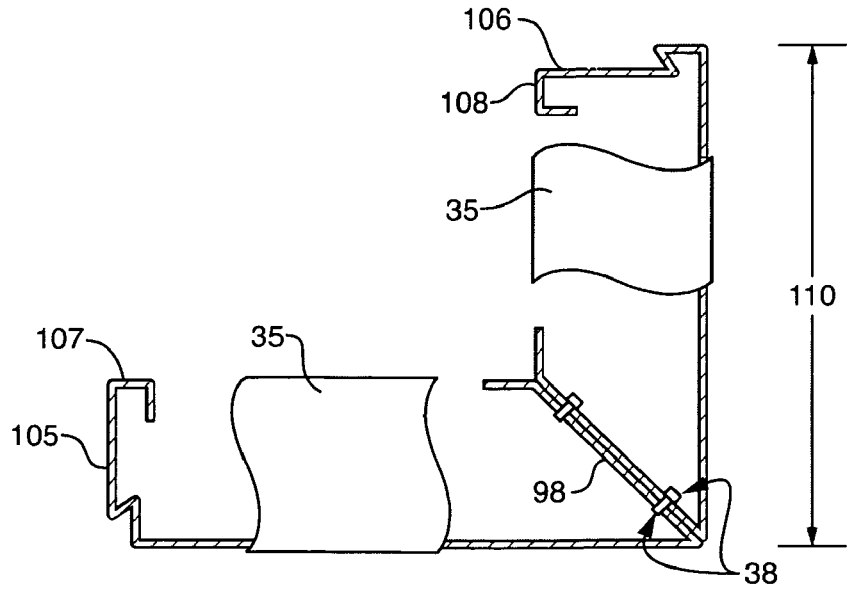
FIG. 23 is a top view taken along lines 23-23 of FIG. 22.

FIGS. 20 and 21 show a wall construction for wall 12 that has door opening 15. As with a window, a truss 60 is placed over the door opening 15, the width of the truss being greater than the width of the door opening 15. The truss is supported with a pair of opposed door frame panels 92, each having an interlocking section 93 that forms an interlocking connection with a side panel 20 of a full length wall panel 18. This interlocking connection can be seen in FIG. 21. Opposite interlocking section 93 is a non-interlocking side panel 94 that can be reinforced with a vertically extended column 96 that can be in the shape of a channel beam. The door frame panel 92 can provide rear panels 95 to which Sheetrock® or other inside wall panel material 58 can be attached.

In FIGS. 22-25, a corner 97 forms the connection between two walls 11, 14. Corner 97 employs a corner column 98 constructed of two column parts 99, 100. These column parts 99, 100 can provide openings 101 so that electrical wiring or plumbing can be routed through the parts 99, 100. It should be understood that similar openings 101 can be provided in the side panels 20, 21 of any full length wall panel 18 or in any other side panel or interlocking section disclosed herein. This enables electrical lines and plumbing to be routed within a wall 11, 12, 13, 14 in between section 19 and inside wall panel 58.

Figure 24:
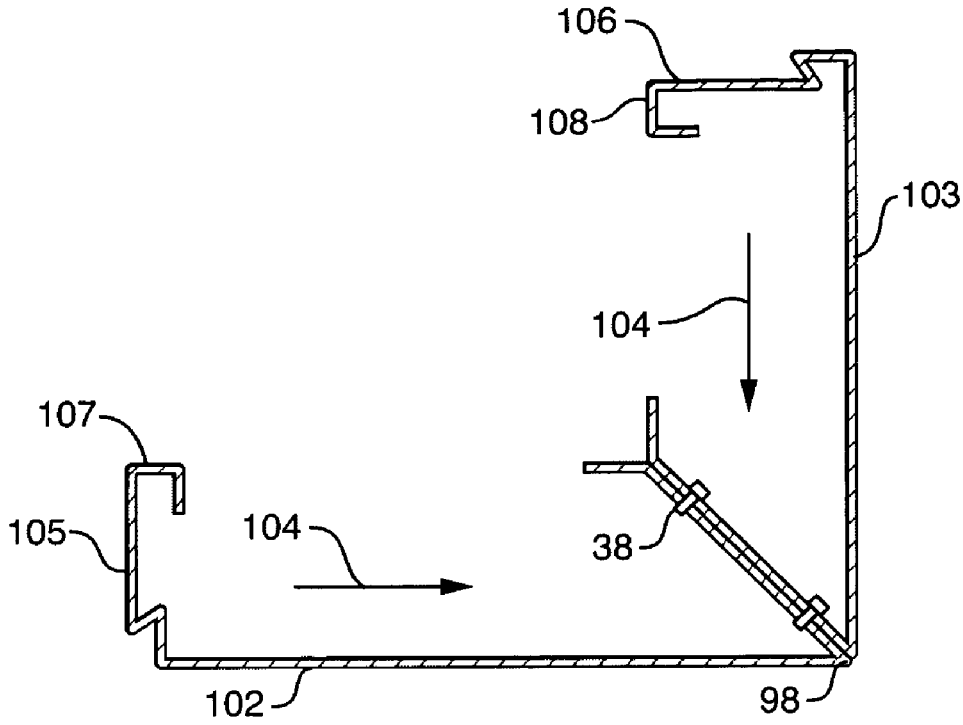
FIG. 24 is fragmentary schematic plan view illustrating assembly of the corner construction of FIGS. 22 and 23.

A pair of corner wall panels 102, 103 are connectable to column 96 using screws 38 or other suitable fasteners. Column parts 99, 100 are also connectable together using fasteners such as screws 38. Arrows 104 in FIG. 24 illustrate the connection of corner wall panels 102, 103 to column 98. Each corner wall panel 102, 103 provides an interlocking section 105 or 106 that can form an interlocking connection with a full length wall panel 18 such as the interlocking connection shown in FIG. 2.

Figure 25:
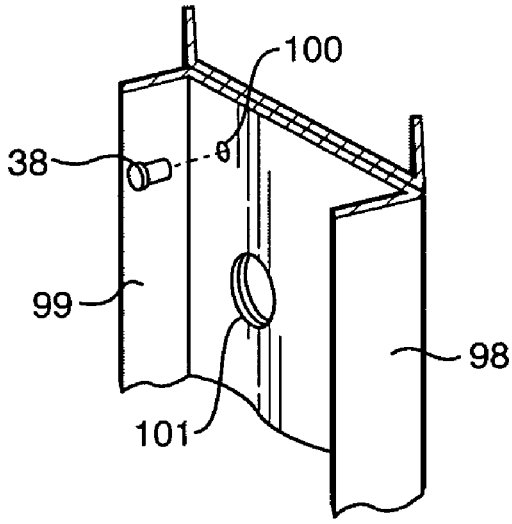
FIG. 25 is a fragmentary view illustrating part of the corner construction of FIGS. 22-24.
Figure 26:
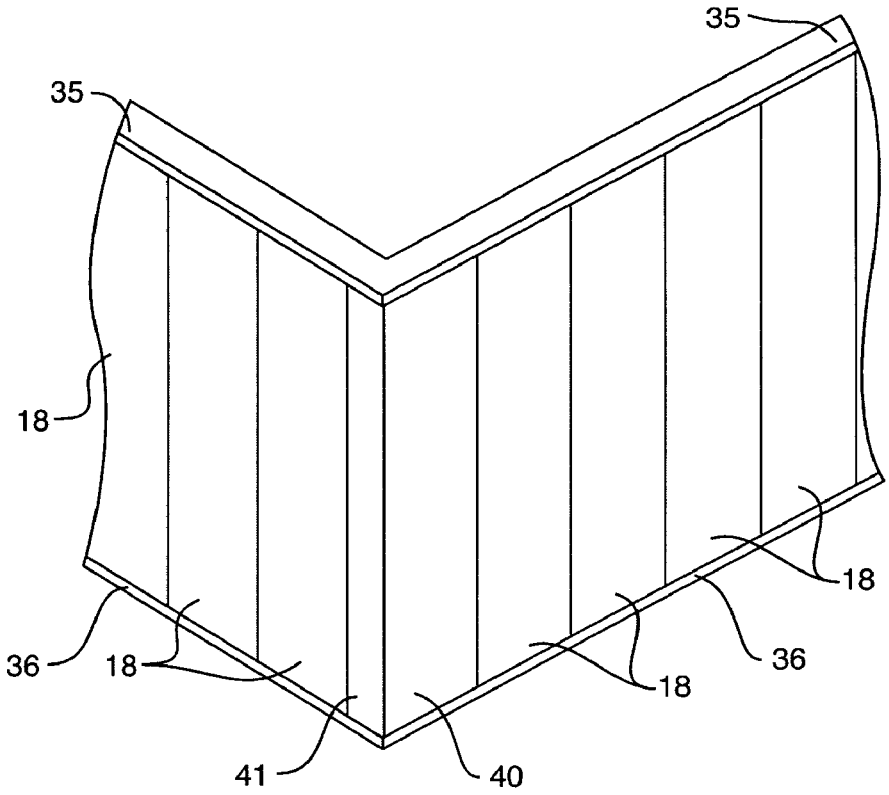
FIG. 26 is a schematic plan view illustrating another corner construction for use with the preferred embodiment of the apparatus of the present invention.
Figure 27:
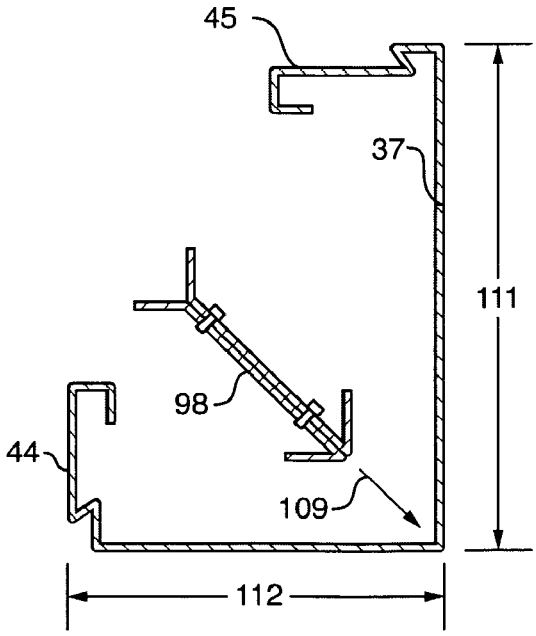
FIG. 27 is a partial perspective view of the corner construction of FIG. 26.
Figure 28:
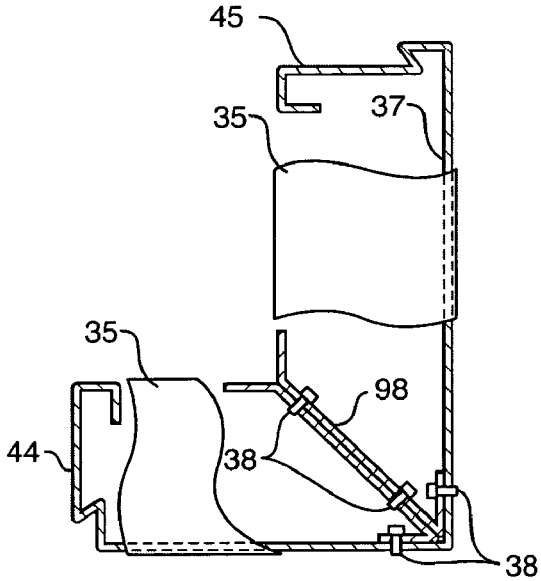
FIG. 28 is a plan, cut-away view of the corner construction of FIGS. 25 and 26.
Figure 29:
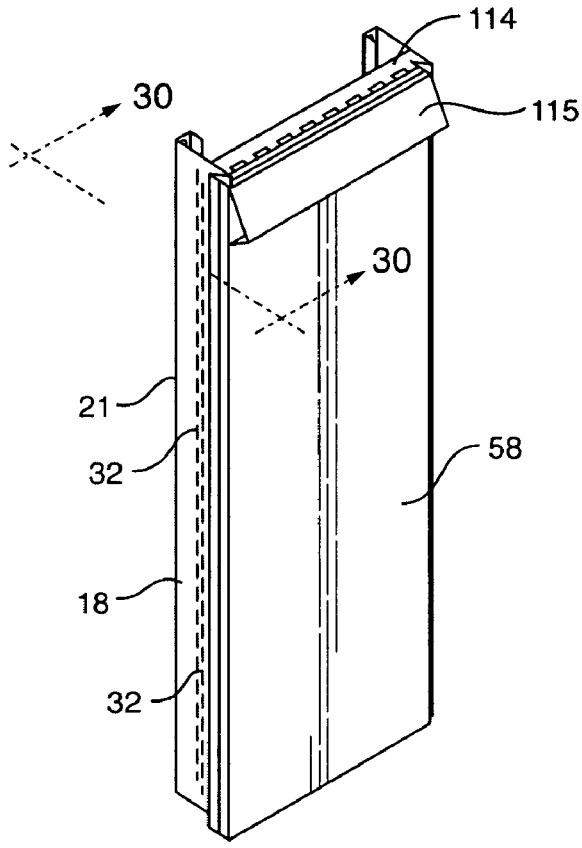
FIG. 29 is a partial perspective view of the preferred embodiment of the apparatus of the present invention illustrating an optional wall panel that is insulated.
Figure 30:
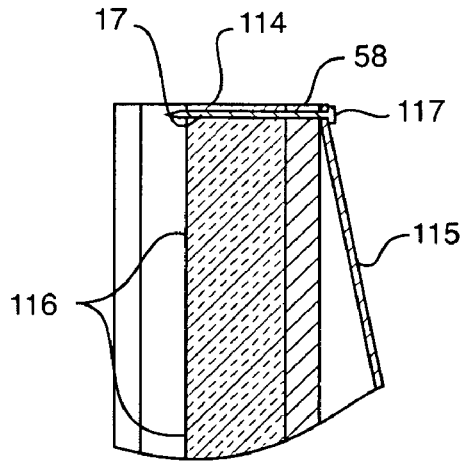
FIG. 30 is a sectional view of taken along lines 30-30 of FIG. 29.

Each interlocking section 105 or 106 is provided with an inner panel section 107 and 108 to which an inside wall panel can be attached. Corner column 98 can also be used with a corner panel 37 shown in FIGS. 7 and 8. FIGS. 25-27 shows the use of a corner panel in combination with column 98. It should be understood that the dimension A at 110 in FIG. 23 for the distance between the corner column 98 to interlocking section 106 of panel 103 can be the same for both panels 102, 103 or can be different such as dimensions 111, 112 for the panel 37 shown in FIGS. 25-27. In FIGS. 25-27, the dimension 11 (Dim. B) is longer than the dimension 112 (Dim. C). This construction enables a corner panel 37 or the two corner panels of FIGS. 22-25 to be used to adjust the two length of a wall if the full length panels 18 are of the same width and the wall dimension is not equal to an exact multiplier of that panel width. Column 98 is inserted in the direction of arrow 109 in FIG. 27.

Figure 31:
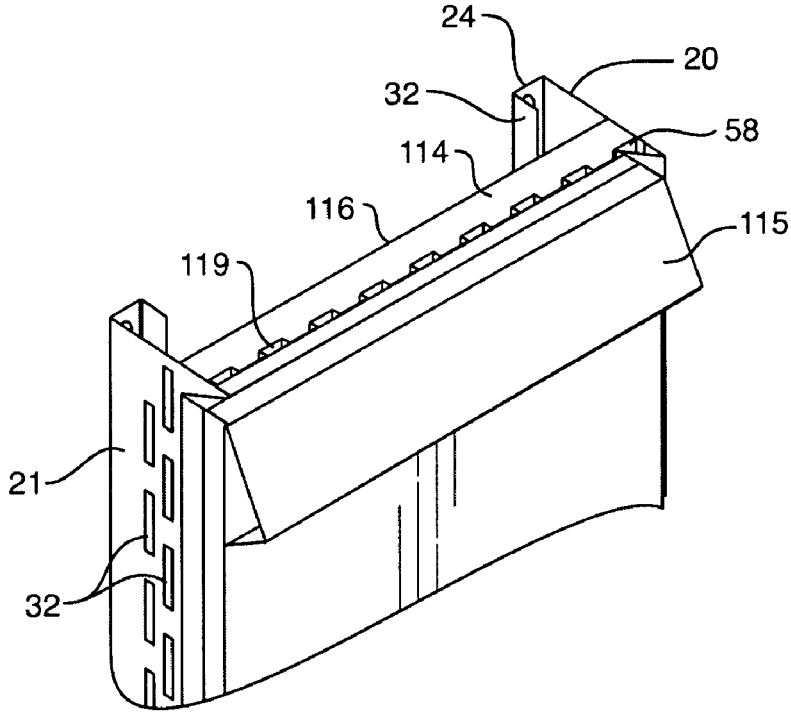
FIG. 31 is a fragmentary perspective view of the panel of the FIGS. 29 and 30.
Figure 32:
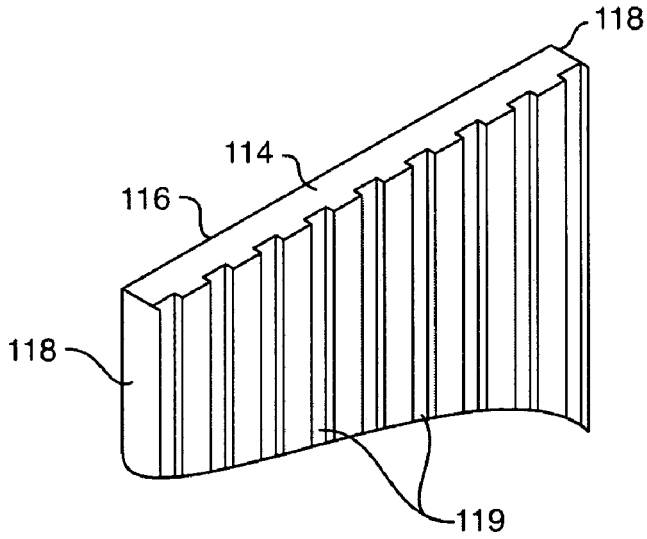
FIG. 32 is a partial perspective view of the preferred embodiment of the apparatus of the present invention illustrating the wall construction of FIGS. 29-30 used to construct a wall.

In FIGS. 29-32, an insulated arrangement is shown for a full length panel 18. The insulation includes insulation layer 114, inside wall panel 58, sheet metal panel 116, and fastener 117, such as common nail. The construction of FIGS. 29-32 enables a fastener or common nail to be used to attach siding 115 to a wall 11, 12, 13, 14 wherein the nail or fastener penetrates and holds together the siding, inside wall panel 58, insulation 114, and sheet metal panel 116. The sheet metal panel 116 can provide flanges 118 that extend on opposing sides of the insulation 114 as shown in FIG. 31. Further, the insulation layer 114 can be grooved on one or all surfaces, providing grooves 119.

Figure 33A:
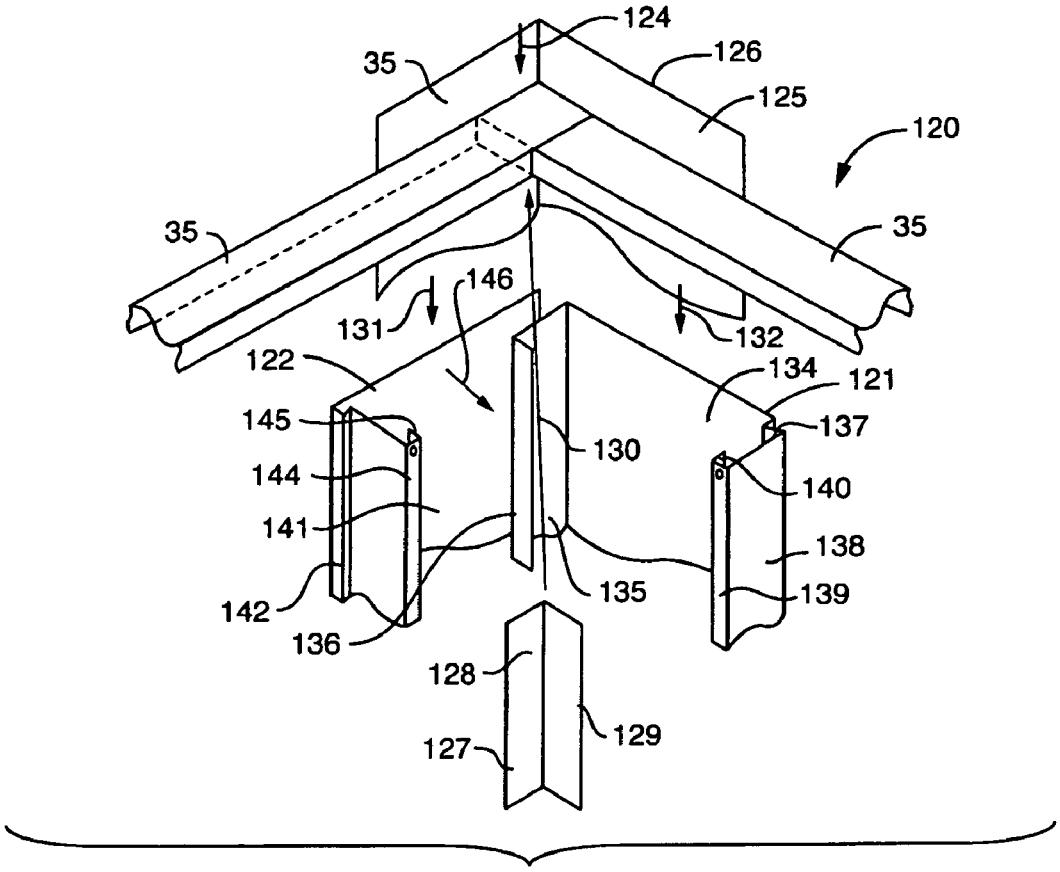
FIG. 33A is a partial perspective view of the preferred embodiment of the apparatus of the present invention showing another optional corner construction.
Figure 33B:
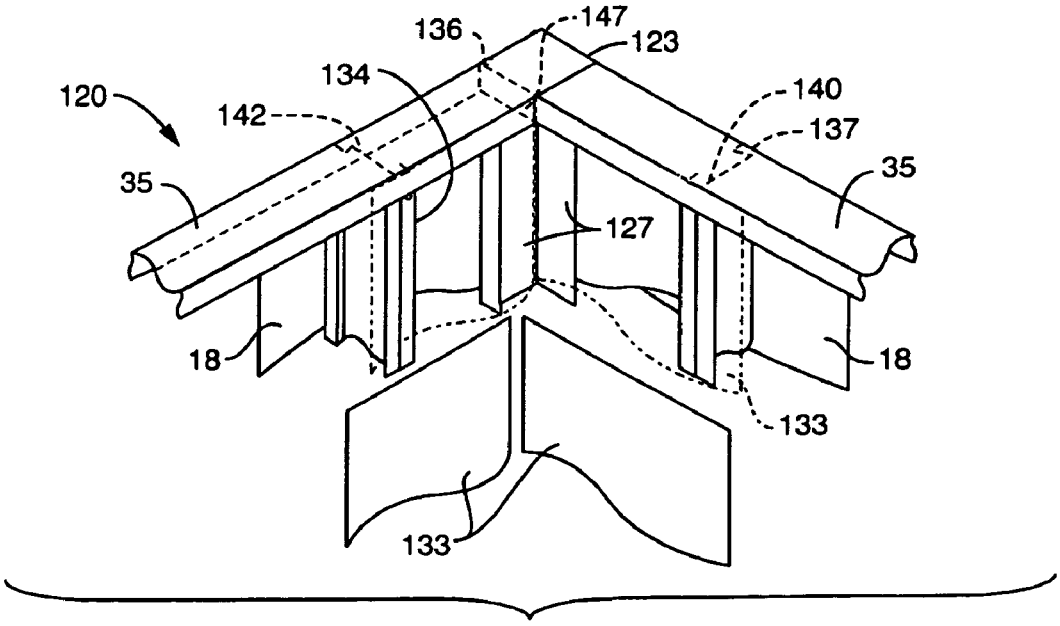
FIG. 33B is a partial perspective view of the preferred embodiment of the apparatus of the present invention showing another optional corner construction.

FIGS. 33A-33B show another corner construction that can optionally be used with the apparatus 10 of the present invention. Corner 120 can be constructed using two connecting panels including starting panel 121 and ending panel 122. Standard dimension full length panels 18 can be connected to panels 121, 122 at respective Z shaped portions 137, 142 (see FIG. 33B). Z shaped portions 137, 142 can be of the same configuration as the Z shaped portions of a full length panel 18 (see FIG. 5). Upper longitudinal beams 35 can be attached to the top of panels 18, 121, 122, 18 (see arrows 131, 132 in FIG. 33A). Lower longitudinal beams 36 can be connected to the bottom of connected panels 18, 121, 122, 18.

Outside L-shaped panel 123 can be attached (e.g. with fasteners 38) to the assembly of panels 18, 121, 122, 18 and beams 35, 36 by engaging outside panels 134, 141 as indicated by arrow 126 in FIG. 33A. Panel 123 has 20 flanges 124,125 that form an angle of about ninety degrees (90°).

Inside L-shaped panel 127 can be attached to the assembly of beams 35, 36 and panels 18, by attaching (e.g. with fasteners 38) to beams 35, 36 as indicated by arrow 25 130 in FIG. 33A. Because flange 136 is shorter (e.g. 1 inch) than the width (e.g. 3½ inches) of beams 35, 36 a gap 147 (e.g. 2½ inches) is provided so that electrical wiring can be routed through corner 120. Inside L-shaped panel 127 is formed of flanges 128, 129 that intersect at an 30 angle of about ninety degrees (90°).

An inside wall veneer can be attached to a building 10 that employs corner 120. In FIG. 33B, veneer panels 133 (e.g. Sheetrock®) are shown attached to an assembly of panels 18, 121, 122, 123, 127, 18 and beams 35, 36.

Starting panel 121 is comprised of outside panel 134 and transverse end panels 135, 138 attached respectively to opposing ends of panel 134. Panel 135 has flange 136 that is generally parallel to panel 134. Panel 138 connects to panel 134 with Z shaped portion 137. Panel 138 connects to flange 139. Flange 139 connects to flange 140. Flange 139 is generally parallel to panel 134. At corner 120, inside veneer panels 133 (e.g. wood paneling, Sheetrock®, etc. attach to flanges 129 and 139.

Ending panel 122 provides an outside panel 141 that can be dimensioned to satisfy any outside wall dimension that is specified, for example, by an architect. Typically, the outside wall panels 133 selected during construction are of a standard four by eight (4'×8') sheet size. Paneling such as wood paneling, plywood, Sheetrock®, are all typically provided in four by eight (4'×8') foot sheets. Ideally, a wall is sized so that the inside panels 133 (sized four by eight feet) will exactly fit without having to cut a panel 133. However, an architect might select a dimension that requires an inside wall panel 133 to be cut. In such a situation, standard full length panels 18 can be used in combination with starting panel 134 to provide any specified wall dimension. Any extra dimension that is required after a starting panel 121 and a number of standard width panels 18 are erected, can be supplied by a custom sized or cut end panel 122. Ending panel 122 can be manufactured to any dimension, or can be oversized and then cut in the field to fit by cutting outside panel 141.

Ending panel 122 provides Z shaped portion 142, transverse end panel 143, flange 144 (generally parallel with outside panel 141) and flange 145 that forms an angle of about ninety degrees with outside panel 141.

Arrow 146 in FIG. 33A illustrates the assembly of ending panel 122 to starting panel 121. Fasteners 38 can be used as needed to assemble the panels 121, 122, beams 35, 36, outside ell shaped panel 123, and inside ell shaped panel 128, and inside wall panels 133.

The following is a list of parts and materials suitable for use in the present invention:

PARTS LIST:

| Part Number | Description |
|---|---|
| 10 | metal building |
| 11 | wall |
| 12 | wall |
| 13 | wall |
| 14 | wall |
| 15 | door |

-continued

PARTS LIST:

| Part Number | Description |
|---|---|
| 16 | window |
| 17 | roof |
| 18 | full length panel |
| 19 | enlarged planar front panel |
| 20 | side panel |
| 21 | side panel |
| 22 | Z-shaped section |
| 23 | Z-shaped section |
| 24 | rear panel |
| 25 | real panel |
| 26 | diagonally extending section |
| 27 | side panel section |
| 28 | diagonally extending section |
| 29 | side panel section |
| 30 | side panel section |
| 31 | side panel section |
| 32 | slit or slot |
| 33 | gap |
| 34 | space |
| 35 | upper longitudinal beam |
| 36 | lower longitudinal beam |
| 37 | corner panel |
| 38 | screw |
| 39 | cut-out |
| 40 | panel section |
| 41 | panel section |
| 42 | corner |
| 43 | bend |
| 44 | interlocking panel |
| 45 | interlocking panel |
| 46 | corner reinforcement |
| 47 | flange |
| 48 | flange |
| 49 | panel section |
| 50 | bend |
| 51 | panel section |
| 52 | bend |
| 53 | panel section |
| 54 | bend |
| 55 | panel section |
| 56 | bend |
| 57 | recess |
| 58 | inside wall panel |
| 59 | short wall panel |
| 60 | truss |
| 61 | width |
| 62 | height |
| 63 | slab |
| 64 | inside plate reinforcement |
| 65 | panel |
| 66 | panel |
| 67 | combined width |
| 68 | column |
| 69 | interlocking portion |
| 70 | interlocking portion |
| 71 | column part |
| 72 | column part |
| 73 | flange |
| 74 | flange |
| 75 | flange |
| 76 | recess |
| 77 | interlocking part |
| 78 | flange |
| 79 | flange |
| 80 | flange |
| 81 | arrow |
| 82 | arrow |
| 83 | width |
| 84 | beam |
| 85 | web |
| 86 | flange |
| 87 | flange |
| 88 | slot |
| 89 | slotted portion |
| 90 | slotted portion |

-continued

PARTS LIST:

| Part Number | Description |
|---|---|
| 91 | outer surface |
| 92 | door frame panel |
| 93 | interlocking section |
| 94 | side panel |
| 95 | rear panel |
| 96 | column |
| 97 | corner |
| 98 | corner column |
| 99 | column part |
| 100 | column part |
| 101 | opening |
| 102 | corner wall panel |
| 103 | corner wall panel |
| 104 | arrow |
| 105 | interlocking section |
| 106 | interlocking section |
| 107 | inner panel section |
| 108 | inner panel section |
| 109 | arrow |
| 110 | dimension line |
| 111 | dimension line |
| 112 | dimension line |
| 114 | insulation layer |
| 115 | siding |
| 116 | sheet metal panel |
| 117 | fastener |
| 118 | flange |
| 119 | groove |
| 120 | corner |
| 121 | starting panel |
| 122 | ending panel |
| 123 | outside L-shaped panel |
| 124 | flange |
| 125 | flange |
| 126 | arrow |
| 127 | inside L-shaped panel |
| 128 | flange |
| 129 | flange |
| 130 | arrow |
| 131 | arrow |
| 132 | arrow |
| 133 | inside wall panel |
| 134 | outside panel |
| 135 | transverse end panel |
| 136 | flange |
| 137 | Z shaped portion |
| 138 | transverse end panel |
| 139 | flange |
| 140 | flange |
| 141 | outside panel |
| 142 | Z shaped portion |
| 143 | transverse end panel |
| 144 | flange |
| 145 | flange |
| 146 | arrow |
| 147 | gap |
| 232 | flange |
| 233 | flange |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A metal building, comprising:

a) a slab that supports a plurality of walls that meet at a plurality of corners and that are formed of generally vertically oriented metal panels, each wall having a wall outer surface and a wall inner surface, the metal panels including wall panels each having an enlarged planar front panel with inner and outer surfaces and opposing wall panel edge portions connected to opposite sides of the enlarged planar front panel, each wall panel edge portion having a side panel section with two spaced apart vertical rows of staggered slits or slots with gaps between slits or slots of one row aligning with slits or slots of the other row for retarding heat transfer across each side panel section;

b) the metal panels including a plurality of corner panels at each corner of the building, each corner panel having opposing corner edge portions that connect with a pair of wall panels at wall panel edge portions;

c) the wall panel edge portions of one wall panel connecting with edge portions of two other metal panels;

d) each of the wall panel edge portions having flanged portions that extend toward each other;

e) connections that join the metal panels together being defined by interlocking sections that are Z-shaped and that extend transversely with respect to the wall outer surface;

f) the wall inner surface being defined by a veneer that is connected to the metal panels at the flanged portions;

g) an insulation layer cladding the inner surface of each enlarged planar front panel between the opposing wall panel edge portions;

h) the corner panels at each corner comprising:

one ending panel having one of the corner edge portions for connecting to an edge portion of an adjacent wall panel at a Z-shaped interlocking section, and a planar outside panel plate extending at an angle from the Z-shaped interlocking section and into the corner and having no flange portion;

a starting panel having the other corner edge portion of the corner panel for connecting to an edge portion of an adjacent wall panel at a Z-shaped interlocking section, and an opposing flange portion extending into the corner, the planar outside panel plate of the ending panel overlapping the opposing flange portion of the starting panel;

i) an outside L-shaped panel engaged over the outside of the planar outside panel plate of the ending panel and over the outside of the opposing flange portion of the starting panel to form an outside of each corner;

j) an inside L-shaped panel spaced inwardly of the outside L-shaped panel to form an inside of each corner; and k) a plurality of fasteners for connecting the metal panels to each other.

2. The metal building of claim 1 wherein at least one wall has a window, wherein a plurality of short wall panels are below the window.

3. The metal building of claim 1 wherein at least one wall has a door, each wall including an upper longitudinal beam and a lower longitudinal beam, each beam having a web and a pair of opposite flanges extending at about a right angle to the web, at least one flange of the lower beam having at least one L-shaped slot therein that extends partly to the web for draining water from the lower beam.

4. The metal building of claim 2 wherein the wall panels and the window each have a width, the window width being greater than the width of the plurality of short wall panels that are positioned below the window.

5. A metal building, comprising:

a) an underlying support;

b) a plurality of metal walls providing an outer wall surface;

c) the walls supporting a roof;

d) the metal walls connecting at corners;

e) each metal wall being comprised of a plurality of metallic wall panels connected together at panel joints, each wall panel having a first section with opposing end portions and second and third sections attached respectively to the first section end portions, there being an insulation layer cladding an inner surface the first section between the end portions;

f) each of said second and third sections extending away from the first section and having a Z-shaped portion;

g) each Z-shaped section having a free end portion that carries at least one flange, the flanges of the Z sections of a wall panel extending toward each other;

h) at least one corner having Z-shaped portions that interlocks with a Z-shaped portion of each adjacent wall panel, the corner comprising:

one ending panel having one Z-shaped portion for connecting to an end portion of an adjacent wall panel, and a planar outside panel plate extending at an angle from the Z-shaped portion and into the corner and having no flange portion;

a starting panel having one Z-shaped portion for connecting to an end portion of an adjacent wall panel, and an opposing flange portion extending into the corner with the planar outside panel plate of the ending panel overlapping the opposing flange portion of the starting panel;

an outside L-shaped panel engaged over an outside of the planar outside panel plate of the one ending panel and over an outside of the opposing flange portion of the starting panel to form an outside of the corner; and an inside L-shaped panel spaced inwardly of the outside L-shaped panel to form an inside of the corner; and i) a plurality of fasteners for connecting the wall panels to each other.

6. The metal building of claim 5 wherein one of said second and third sections has five flat sections.

7. The metal building of claim 5 further comprising a header connected to the top of the wall panels.

8. The metal building of claim 7 wherein a pair of said flanges extend upwardly.

9. The metal building of claim 5 wherein each wall panel has a void space in between the second and third sections and insulation is positioned in the void space.

10. A metal building, comprising:

a) an underlying support;

b) a plurality of metal walls providing an outer wall surface;

c) the walls supporting a roof;

d) the metal walls connecting at corners;

e) each metal wall being comprised of a plurality of metallic wall panels connected together at panel joints, each wall panel having a first section with opposing end portions and second and third sections attached respectively to the first section end portions;

f) each of second and third sections including a side panel with two spaced apart vertical rows of staggered slits or slots with gaps between slits or slots of one row aligning with slits or slots of the other row for retarding heat transfer across each side panel, each of said second and third sections also extending away from the first section and having a Z-shaped portion;

g) each Z-shaped section having a free end portion that carries at least one flange, the flanges of the Z sections of a wall panel extending toward each other;

h) at least one corner having a Z-shaped portion that interlocks with a Z-shaped portion of a wall panel, the corner comprising:

one ending panel having one Z-shaped portion for connecting to an end portion of an adjacent wall panel, and a planar outside panel plate extending at an angle from the Z-shaped portion and into corner and having no flange portion;

a starting panel having one Z-shaped portion for connecting to an end portion of an adjacent wall panel, and an opposing flange portion extending into the corner with the planar outside panel plate of the ending panel overlapping the opposing flange portion of the starting panel;

an outside L-shaped panel engaged over an outside of the planar outside panel plate of the one ending panel and over an outside of the opposing flange portion of the starting panel to form an outside of the corner; and an inside L-shaped panel spaced inwardly of the outside L-shaped panel to form an inside of the corner; and j) a plurality of fasteners for connecting the wall panels to each other.

11. The metal building of claim 10 wherein at least one wall has a window, each wall including an upper longitudinal beam and a lower longitudinal beam, each beam having a web and a pair of opposite flanges extending at about a right angle to the web, at least one flange of the lower beam having at least one L-shaped slot therein that extends partly to the web for draining water from the lower beam.

12. The metal building of claim 11 wherein the wall panels and the window each have a width, the window width being greater than the width of a plurality of the wall panels that are positioned below the window, at least one vertical columns having a column part with a recess for receiving part of a wall panel at one side of the window by a selected amount for setting an effective width opening of the window.

13. The metal building of claim 12 further comprising a truss over the window, the truss having edge portions that connect to wall panel edge portions.

14. The metal building of claim 13 further comprising a pair of vertical columns that support the truss at positions on opposing sides of the window, wherein the distance between the columns is greater than the window width.

15. The metal building of claim 14 wherein each column supports an end portion of the truss.

16. A metal building, comprising:

a) a slab that supports a plurality of walls that are formed of generally vertically oriented metal panels having upper and lower ends, an upper longitudinal beam connected to the upper ends of the panels and a lower longitudinal beam connected to the lower ends of the panels, the lower longitudinal beam having a web that rests upon the slab and an outer flange having at least one L-shaped slot therein that extends partly to the web for draining water from the lower beam, each wall having an outer surface and an inner surface, the metal panels including wall panels having opposing wall panel edge portions;

b) the metal panels including a plurality of metal corner panels having opposing corner edge portions that connect with a pair of wall panels at wall panel edge portions, each corner panel comprising:

one ending panel having one Z-shaped portion for connecting to an end portion of an adjacent wall panel, and a planar outside panel plate extending at an angle from the Z-shaped portion extending to the corner and having no flange portion;

a starting panel having one Z-shaped portion for connecting to an end portion of an adjacent wall panel, and an opposing flange portion extending into the corner with a planar outside panel plate of the ending panel overlapping the opposing flange portion of the starting pane;

an outside L-shaped panel engaged over an outside of the a planar outside panel plate of the one ending panel and over an outside of the opposing flange portion of the starting panel to form an outside of the corner; and an inside L-shaped panel spaced inwardly of the outside L-shaped panel to form an inside of the corner;

c) wherein the wall panel edge portions of one panel connecting with edge portions of two other metal panels;

d) each of the panels having flanged portions that extend toward each other;

e) connections that join panels together being defined by the Z-shaped interlocking sections and that extend transversely with respect to the wall outer surface;

f) the wall inner surface being defined by a veneer that is connected to the metal panels at the flanged portions;

g) a cover that attaches to the walls and shields at least part of the interior; and h) a plurality of fasteners for connecting the metal panels to each other.

17. The metal building of claim 16 wherein at least one wall has a window.

18. The metal building of claim 17 wherein the wall panels and the window each have a width, the window width being greater than the width of a plurality of the wall panels that are positioned below the window.

19. The metal building of claim 18 further comprising a truss formed of a plurality of short wall panel sections that are attached above and below to truss beams, the truss having edge portions that connect to wall panel edge portions.

20. The metal building of claim 16 wherein each corner forms an angle of about 90 degrees, the starting and ending panels having different dimensions.

* * * * *